United States Patent [19]

Schimko et al.

[11] Patent Number: 4,463,579

[45] Date of Patent: Aug. 7, 1984

[54] DOUBLE CAM UNIT FOR KNITTING MACHINES

[75] Inventors: Reinhold Schimko, Aalen-Wasseralfingen; Gottfried Kühnert, Aalen, both of Fed. Rep. of Germany

[73] Assignee: Universal Maschinenfabrik Dr. Rudolf Schieber GmbH & Co. KG, Westhausen, Fed. Rep. of Germany

[21] Appl. No.: 422,503

[22] Filed: Sep. 23, 1982

[30] Foreign Application Priority Data

Sep. 30, 1981 [DE] Fed. Rep. of Germany ..... 3138981

[51] Int. Cl.[3] ..... D04B 7/00

[52] U.S. Cl. ..... 66/75.1; 66/78

[58] Field of Search ..... 66/75.1, 75.2, 78, 64, 66/60 R

[56] References Cited

U.S. PATENT DOCUMENTS 3,615,145 10/1971 Goller et al. ..... 66/78
3,955,381 5/1976 Panchaud ..... 66/75.1
4,287,727 9/1981 Otoshi ..... 66/78
4,294,085 10/1981 Trautner ..... 66/75.1

FOREIGN PATENT DOCUMENTS 2939066 4/1981 Fed. Rep. of Germany ..... 66/75.1

*Primary Examiner*—Ronald Feldbaum
*Attorney, Agent, or Firm*—Sughrue, Mion, Zinn, Macpeak and Seas

[57] ABSTRACT

A double knitting cam unit for knitting machines, with working jacks arranged in the needle channels of the needle beds behind the knitting needles and Jacquard jacks arranged behind these, includes superposed needle cam units (AD), jack cam units (BD) and Jacquard jack cam units (CD) with fixed and movable cam elements. In order to enable a transfer of stitches independently of the carriage traverse direction and independently of the transfer direction towards the front, towards the rear or in both directions at the same time, the cam units (AD, BD, CD) are made symmetrical to the central line (L) between the two parts of the double knitting cam unit and each needle or jack cam unit (AD, BD) contains movable transfer cam elements (1/1) and each jack or needle cam unit (BD, AD) contains movable acceptor cam elements (9, 8) for stitch transfer. Preferably, the movable transfer cam elements (1/1) are made movable in the needle cam unit (AD) in the longitudinal direction of the needles and the movable acceptor cam elements (8, 9) are provided in the jack cam unit (BD).

5 Claims, 5 Drawing Figures

DOUBLE CAM UNIT FOR KNITTING MACHINES

DESCRIPTION

The invention relates to a double knitting cam unit for knitting machines with working jacks arranged in the needle channels of the needle beds behind the knitting needles and Jacquard jacks arranged behind these with superposed needle cam units, jack cam units and Jacquard jack cam units with fixed and movable cam elements.

Cam units for knitting machines are known which, arranged side-by-side, can only knit or only transfer. Furthermore, cam units are known which are arranged under one another and operate with double-foot needles. Finally, a combined knit-transfer double cam unit is known with which stitches can only be transferred with the leading cam unit in one direction, e.g. forwardly for stitches leading from right to left and rearwardly for stitches leading from left to right.

The invention is based upon the problem of providing a double knitting cam unit of the kind described initially, with which any stitches can be transferred without additional transfer cam units, that is independently of the carriage traverse direction and of the transfer direction, from front to rear, from rear to front or simultaneously in both directions.

This purpose is solved in accordance with the invention in that the cam units are made symmetrical about the central line between the two parts of the double knitting cam unit and that each needle or jack cam unit contains movable transfer cam elements and each jack or needle cam unit contains movable acceptor cam elements for stitch transfer.

With this combined knit-transfer cam unit, independently of the carriage traverse direction, all knit-stitch, tuck-stitch and slip-stitch combinations can be produced to the front and to the rear, from transfers and from stitches in both carriage traverse directions. Since each double knitting cam unit represents a complete and self-contained unit, any number of cam units can be arranged side-by-side, in order to increase the productivity.

Preferably, the movable transfer cam elements are provided in the needle cam units and the movable acceptor cam elements are provided in the jack cam units.

The movable transfer cam elements in the needle cam units are advantageously made movable in the longitudinal direction of the needles, preferably being made in two parts on a common plate.

Advantageously, the movable acceptor cam elements are also used for tuck-stitch formation.

Preferably, the movable transfer cam elements include an ejector cam surface for withdrawing the knitting needles during knit-stitch formation.

The jack cam units advantageously include movable cam elements for bringing into actuation all working jacks.

Finally, the Jacquard jack cam units advantageously include one or more superposed rows of selector elements.

The invention is further described below in conjunction with an embodiment in connection with the drawings. In the drawings.

Figure 4:
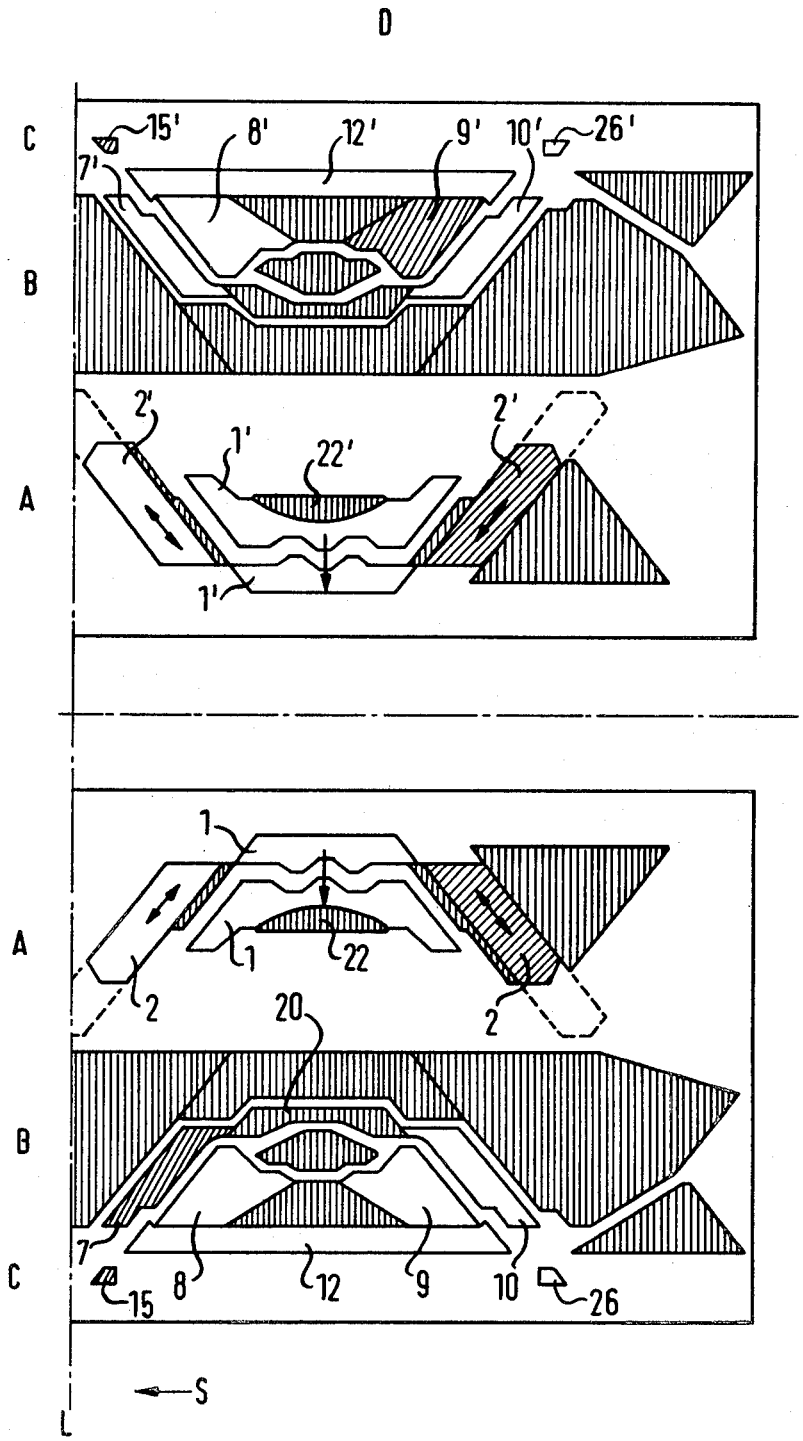
Figure 5:
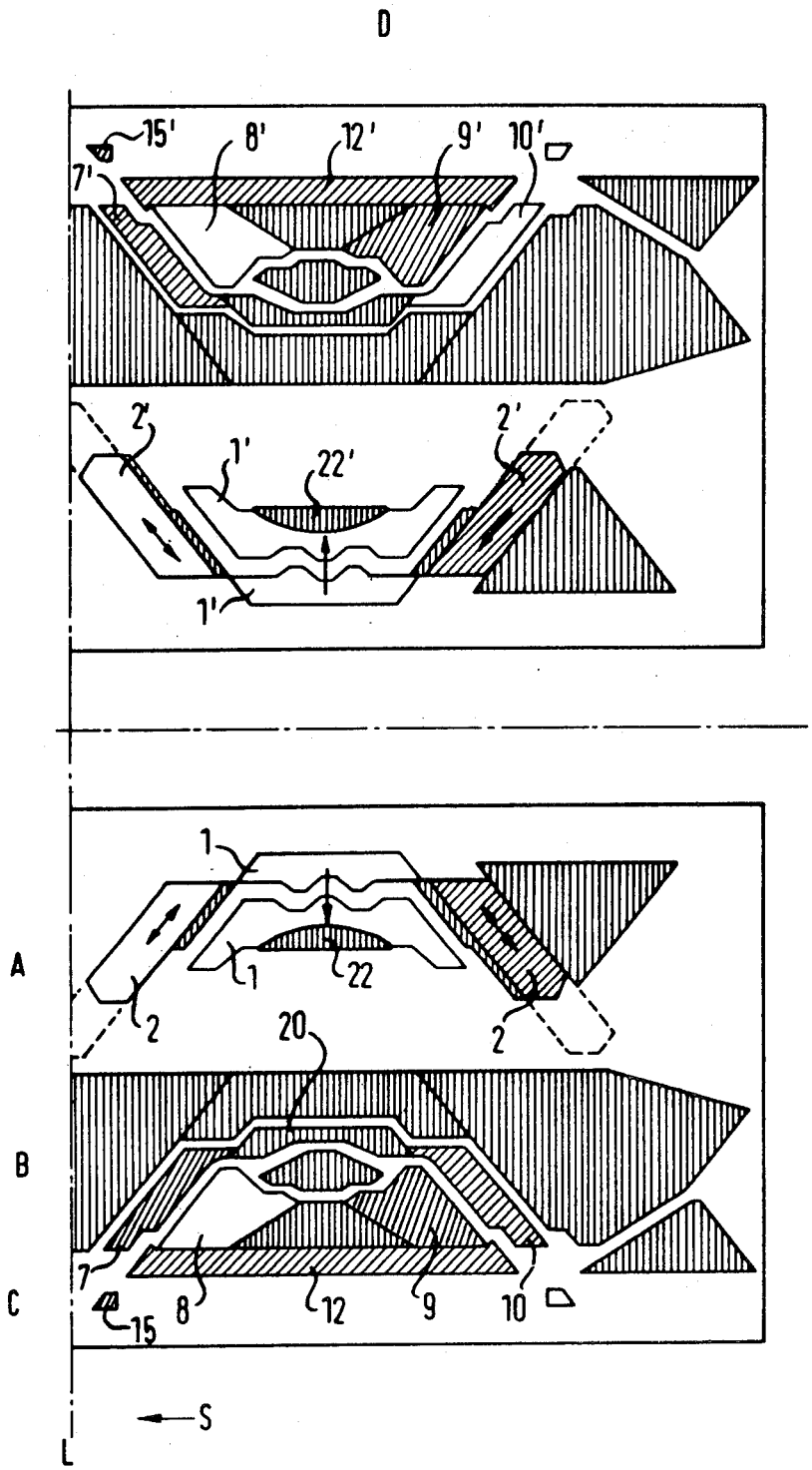

FIG. 4 shows the right-hand part of a double knitting cam unit for both needle beds, where the knitting cam unit for the front needle bed is arranged for the transfer and the knitting cam unit for the rear bed for the acceptance of stitches; and FIG. 5 shows the right-hand part of a double knitting cam unit for both needle beds, where the front and rear knitting cam units are arranged for the transfer and the acceptance of stitches.

Figure 1:
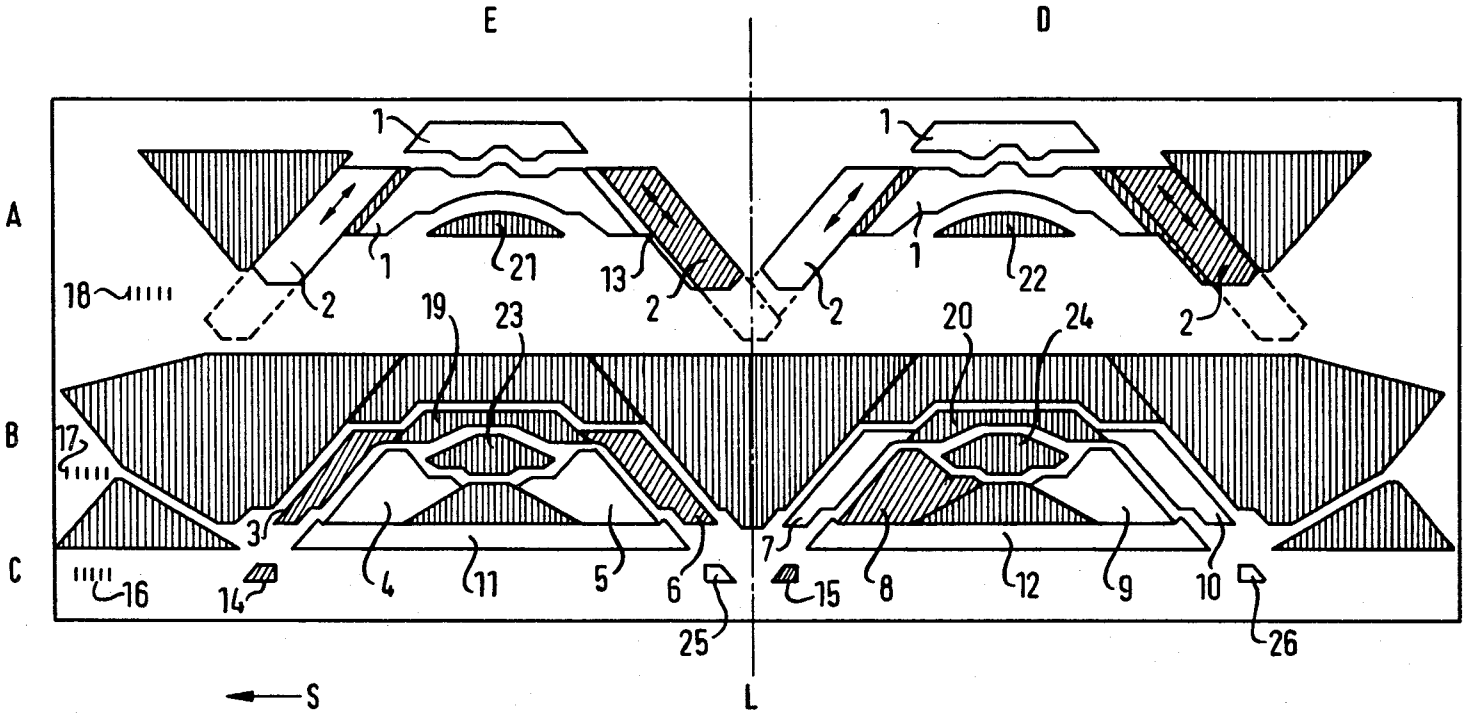
FIG. 1 shows a double knitting cam unit according to the invention for a needle bed of a flat-bed knitting machine, where the left part of the knitting cam unit is arranged for knit-stitch formation and the right part of the knitting cam unit is arranged for tuck-stitch formation.
Figure 2:
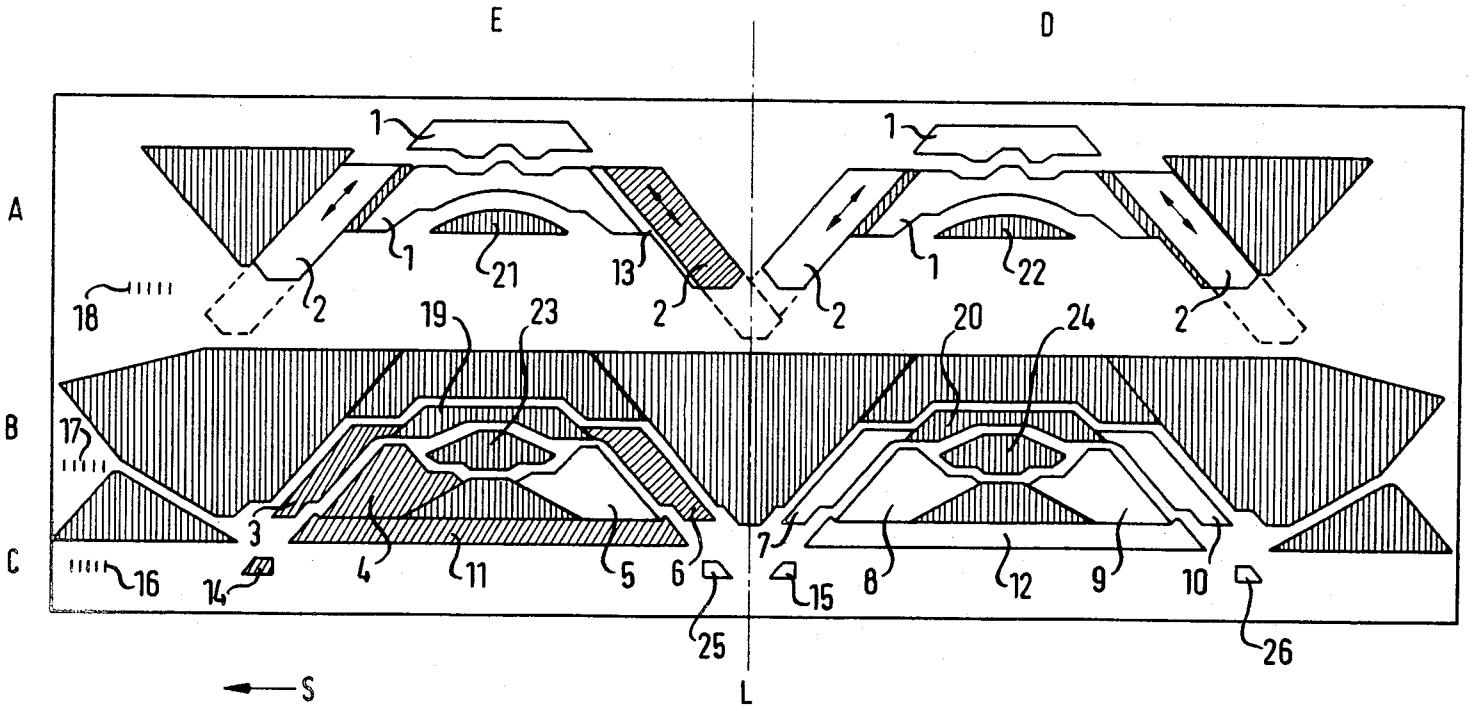
FIG. 2 shows a double knitting cam unit as in FIG. 1, where the left part of the knitting cam unit is arranged for simultaneous knit-stitch formation and tuck-stitch formation.
Figure 3:
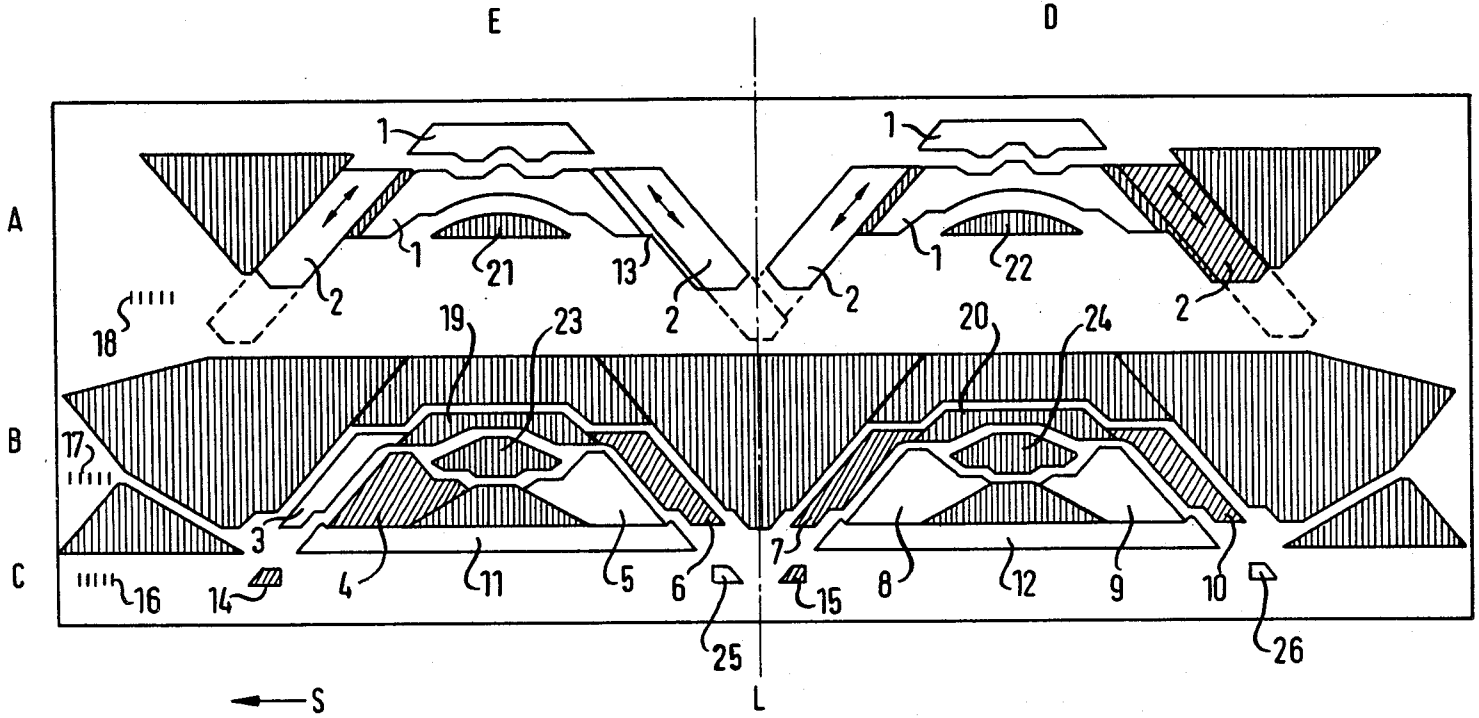
FIG. 3 shows a double knitting cam unit as in FIG. 1, where the two parts of the knitting cam unit are arranged for knitting by the three-path technique.

In FIGS. 1 to 3, a combined knit transfer cam unit of double cam unit construction for a needle bed of a flat-bed knitting machine is shown. The double knitting cam unit consists of two needle cam units AE and AD, two jack cam units BE and BD and two Jacquard jack cam units CE and CD. All fixed non-movable cam elements are cross-hatched vertically. The needle cam units AE and AD, the jack cam units BE and BD and also the Jacquard jack cam units CE and CD are made symmetrical about the central line L.

Transfer cam elements 1/1 of each needle cam unit are located upon a plate so that they can be moved together in the longitudinal direction of the needles in the appropriate needle cam units. Cam elements 2 constitute the inner withdrawal triangles and, in addition to movement in the direction of the double arrow shown, can be lowered or moved into actuation as also can the bar member 13 lying on the left-hand inner cam element 2. Cam elements 3, 4, 5, 6, 7, 8, 9, 10, 11 and 12 of the jack cam units, as well as selector elements 14, 15, 25 and 26 of the Jacquard jack cam units, are movable out of and into actuation independently of one another by lowering and return movements. One or more rows of selector elements can be provided.

From the Jacquard jack cam units CE and CD, feet 16 of Jacquard jacks, from the jack cam units BE and BD, feet 17 of working jacks arranged in the needle channels and in front of the Jacquard jacks and, from the needle cam units AE and AD, feet 18 of knitting needles arranged in front of the working jacks are engaged.

The transfer cam elements 1/1, except during the transfer of stitches as shown in FIGS. 1 to 3, are always moved upwards in the longitudinal direction of the needles.

In FIGS. 1 to 5 of the drawings, the cam elements moved into actuation are represented with inclined crosshatching. In all Figures, the cam element positions are shown during a carriage traverse from right to left in the direction of the arrow S.

In FIG. 1, the position of the cam elements in the leading knitting cam E for knit-stitch formation is shown. The transfer cam elements 1/1 are moved upwardly, which moves the cam elements 3 and 6 into actuation. The feed 16 of the Jacquard jacks are engaged by the selector element 14 moved into actuation and thus the corresponding Jacquard jacks are selected. The feet 17 of the working jacks are raised from the Jacquard jacks in the region of the cam element 3 and are moved upwards from this cam element 3, as well as the cam element 19, so that the feet 18 of the knitting needles are engaged by the cam element 21 and are brought into the final enclosed position for knit-stitch formation. The cam element 11 is moved out of actuation.

In FIG. 1 also, the position of the cam elements in the trailing knitting cam unit D for tuck stitch formation is shown. The cam element 7 is moved out of actuation and the cam element 8 is moved into actuation. The working jacks selected by means of the selector element 15 and moved into actuation are engaged at their feet 17 by the cam element 8 and are moved upwards by means of the cam element 24, so that the feet 18 of the knitting needles, brought into the tuck position, move past the cam element 22. The cam element 12 is moved out of actuation. If all the knitting needles are to make tuck knitting, the cam element 12 is moved into actuation, whereas the selector element 15 is not required.

FIG. 2 shows for the leading knitting cam unit E the position of the cam elements which is required in order to form knit-stitches and tuck-stitches in one row with the knitting cam unit E. The cam elements 3, 6, 4 and 11 are moved into actuation. The working jacks of the knit-stitch-forming needles are guided by means of the selector element 14 to the cam element 3, whereas the remaining working jacks of the tuck-stitch-forming needles are guided from the cam element 11 to the cam element 4.

FIG. 3 shows the position of the cam elements for knitting by the three-path technique, which is possible with the aid of the leading selector and the trailing knitting cam unit. When knitting from right to left, the needles for making trailing tuck-stitches are selected by means of the selector element 14. The cam element 3 is out of actuation. The feet 17 of the working jacks slide over the cam element 4 and the cam element 23 moved into actuation and so bring knitting needles into the tuck position for the trailing knitting cam unit E. The working jacks themselves are withdrawn again from the cam element 6 moved into actuation. The inner cam elements 2 as well as the cam element 13 from the left-hand knitting cam unit E are moved out of actuation, so that the knitting needles can move into the tuck position in the trailing knitting cam unit D. In the trailing knitting cam unit D, the remaining needles are selected for knit-stitch and slip-stitch formation. The selector element 15 selects the knitting needles by means of the cam elements 7, 20 and 22 for knit-stitch formation, whereas the non-selected needles are not affected. The cam elements 11 and 12 must remain out of operation.

FIG. 4 shows the position of the cam elements in the trailing cam units D above the front and rear needle beds for the transfer of stitches from front to rear. The transfer cam elements 1/1 of the front knitting cam unit are moved in the longitudinal direction of the needles to the jack cam unit BD, selection is then effected by means of the selector element 15 and the cam element 7 moved into actuation to the transfer cam elements 1/1 in the transfer region. In the knitting cam unit for the rear needle bed, the cam elements 7', 8' and 12' must remain out of actuation and the selector element 15' as well as the cam element 9' must remain in actuation. If the stitches are to be taken off all the needles, then the cam element 12' is moved into actuation and the selector element 15' is moved out of actuation.

FIG. 5 shows the position of the cam elements in the trailing knitting cam units D above the front and rear needle beds for the transfer of stitches in both directions, from front to rear and from rear to front. The transfer cam elements 1/1 and 1'/1' are shifted in the longitudinal direction of the needles to the jack cam units BD/BF, the selection of the stitches to be transferred is effected by means of the selector elements 15 and 15' and the cam elements 7 and 7' moved into actuation to the transfer cam elements 1/1 and 1'/1' in the transfer position. In both knitting cam units, the cam elements 8, 8' must remain out of actuation and the selector elements 15, 15' as well as the cam elements 9, 9' and 12, 12' must remain in actuation.

The cam elements in the knitting cam unit indicated with ' above the rear needle bed correspond to the cam elements in the knitting cam unit above the front needle bed.

The cam element 24 in the jack cam unit BD corresponds to the cam element 23 in the jack cam unit BE.

We claim:

1. A double cam unit for a knitting machine including a Jacquard device having jacks arranged in the needle channels of the needle beds behind the knitting needles, with needle cam units and jack cam units with fixed and movable cam elements arranged in three levels under one another, the cam units being symmetrical about the central line between the two parts of the double cam unit, wherein a jack cam unit level and a Jacquard cam unit level are provided under a needle cam unit level, each needle cam unit is provided with a transfer cam element movable in longitudinal direction of the needles and being symmetrical with respect to a cam cross axis, each jack cam unit is provided with two movable acceptor cam elements for stitch transfer being symmetrical with respect to a cam cross axis, and each jack cam unit is provided with a movable cam element for bringing into actuation all nonselected working jacks and being symmetrical with respect to a cam cross axis.

2. A double cam unit according to claim 1, wherein the movable transfer cam elements are constructed in two parts on a common plate.

3. A double cam unit according to claim 1, wherein the movable acceptor cam elements are also employed for tuck-stitch formation.

4. A double cam unit according to claim 1, wherein the movable transfer cam elements include an ejector cam surface for withdrawing the knitting needles during knit-stitch formation.

5. A double cam unit according to claim 1, wherein the Jaquard jack cam units include one or more superposed rows of selector elements.

* * * * *